US005492797A

United States Patent [19]

Tosaka et al.

[11] Patent Number: 5,492,797

[45] Date of Patent: Feb. 20, 1996

[54] DIRECT POSITIVE SILVER HALIDE COLOR PHOTOGRAPHIC LIGHT-SENSITIVE MATERIAL

[75] Inventors: Yasuo Tosaka; Masayuki Sasagawa, both of Odawara, Japan

[73] Assignee: Konica Corporation, Japan

[21] Appl. No.: 279,213

[22] Filed: Jul. 22, 1994

[30] Foreign Application Priority Data

Jul. 27, 1993 [JP] Japan ..... 5-185204

[51] Int. Cl.[6] ..... G03C 1/485; G03C 1/00

[52] U.S. Cl. ..... 430/505; 430/503; 430/509; 430/510; 430/598; 430/596; 430/940

[58] Field of Search ..... 430/505, 598, 430/510, 596, 503, 509, 940

[56] References Cited

U.S. PATENT DOCUMENTS

| | | | |
|---|---|---|---|
| 3,620,747 | 11/1971 | Hamlin | 430/509 |
| 4,772,542 | 9/1988 | Haga | 430/505 |
| 4,948,712 | 8/1990 | Inoue et al. | 430/598 |
| 4,970,140 | 11/1990 | Heki et al. | 430/502 |

OTHER PUBLICATIONS

Patent Abstracts of Japan, Vol. 14, No. 405; Aug. 31, 1990 JPA–2–157,751.

Patent Abstracts of Japan, vol. 17, No. 179; Apr. 7, 1993 JPA–4–333,839.

*Primary Examiner*—Thorl Chea

*Attorney, Agent, or Firm*—Jordan B. Bierman; Bierman and Muserlian

[57] ABSTRACT

Disclosed is a direct positive silver halide color photographic light-sensitive material comprising a support and provided thereon, a blue-sensitive emulsion layer containing previously unfogged internal latent image-forming silver halide grains having a spectral sensitivity to blue-light, a green-sensitive emulsion layer containing previously unfogged internal latent image-forming silver halide grains having a spectral sensitivity to green-light, a red-sensitive emulsion layer containing previously unfogged internal latent image-forming silver halide grains having a spectral sensitivity to red-light and a hydrophilic colloidal layer, wherein said blue-sensitive emulsion layer is provided so as to be located farther than both said green-sensitive and said red-sensitive emulsion layers from the support; and at least one of said blue-sensitive emulsion layer, said-green sensitive emulsion layer and said red-sensitive emulsion layer or said hydrophilic colloidal layer contains an internal latent image forming silver halide grains having a spectral sensitivity having a part common to the respective spectral sensitivity regions pertaining to said blue-sensitive emulsion layer, said green-sensitive emulsion layer and said red-sensitive emulsion layer; and said spectral sensitivity of said blue-sensitive emulsion layer to said blue-light, is not less than 0.8 of at least one selected from a spectral sensitivity of said green-sensitive emulsion layer to said blue-light or a spectral sensitivity of said red-sensitive emulsion layer to blue-light.

5 Claims, No Drawings

DIRECT POSITIVE SILVER HALIDE COLOR PHOTOGRAPHIC LIGHT-SENSITIVE MATERIAL

FIELD OF THE INVENTION

The present invention relates to a direct positive silver halide color photographic light-sensitive material comprising internal latent image-forming silver halide grains, and more particularly to a direct positive silver halide color photographic light-sensitive material suitably usable for preparing a color proof image from plural black-and-white halftone images that can be obtained by color separation and halftone image conversion in the color graphic-arts/printing process.

BACKGROUND OF THE INVENTION

In a method for preparing a color proof by using a silver halide color photographic light-sensitive material having a white support, a plural number of different black-and-white halftone images obtained by color separation and halftone image conversion from a colored original are printed in sequence on a single color photographic paper in the contact printing manner, and the printed photographic paper is subjected to color-development to get the couplers contained therein to produce imagewise dyes to thereby form a color image for use as a color proof.

In the above technique, however, when on the color proof a color image is formed so as to get closely akin to the color image of the original, the black image density on the color proof lacks as compared to the original's, whereas when the proof's black image density is made so as to have a close resemblance to the original's, the proof's resemblance to the color image of the original is deteriorated, and thus it is very difficult to satisfy the reproductions of both at the same time.

As a means to solve the above disadvantage there is known a technique to provide besides the yellow, magenta and cyan color forming layers a fourth black layer different in the spectral sensitivity from any of the three layers; for example, Japanese Patent Publication Open to Public Inspection (hereinafter abbreviated to JP O.P.I.) No. 122637/1991 discloses a technique to use four different image-forming layers: yellow, magenta, cyan and black image-forming layers. JP O.P.I. Nos. 289846/1990 and 183251/1990 also disclose techniques for improving the above problem. These techniques, however, have such shortcomings that they have need of increasing the number of exposures, resulting in a loss of productivity, or lack the image stability, and therefore, they need further improvements in order to be provided for practical use.

JP O.P.I. No. 100352/1993 discloses a technique to use a silver halide emulsion (hereinafter referred to as a pan chromatic emulsion) having a spectral sensitivity covering all the respective yellow, magenta and cyan image-forming layers. This method must enable the obtaining of the same color densities and quality vividness as the original because color densities can be set so as to be closely akin to that of the original and the panchromatic emulsion can make up for the shortage of blackness formation. However, the actual introduction of the panchromatic emulsion to the light-sensitive material has the disadvantage that it causes the yellow, magenta, cyan and black image densities to become liable to largely change according to fluctuation in the exposure amount, and therefore it needs further improvement.

As a result of our continued investigation, we have now reached the following idea: since it is difficult for both green-sensitive and red-sensitive emulsions to eliminate the blue-sensitivity peculiar to silver halide therefrom, any practical light-sensitive material comprises a blue-sensitive layer as the top layer, a yellow filter layer as an interlayer, and other color-sensitive layers provided thereunderneath. Incidentally, regarding the panchromatic emulsion in a light-sensitive material for use as a color proof, it is expected that its exposed part do not form any color, but its part unexposed to any of blue, green or red light at all alone contribute to black formation, so that particularly where the panchromatic emulsion is incorporated in a layer underneath the yellow filter layer, the decoloration of the panchromatic emulsion due to its exposure to blue light does not function as was set up, and as a result, the formed color density largely varies according to fluctuation in the exposure condition.

Upon this, if the yellow filter should be eliminated, then the earlier-mentioned spectral sensitivity separation becomes impossible.

Accordingly, in order to let the panchromatic emulsion function and to make the spectral sensitivity separation by eliminating the yellow filter layer or reducing the function of the filter layer, we, the inventors, have accomplished the optimization of the respective emulsion layers' sensitivities to blue light, and thus we have made the present invention.

SUMMARY OF TEE INVENTION

It is therefore an object of the present invention to provide a direct positive silver halide color photographic light-sensitive material (hereinafter may be merely called light-sensitive material) which, when used to prepare a color proof according to the halftone image information obtained by the color separation and halftone image conversion of an original, can provide an excellent-quality color proof having stable image densities against possible fluctuation in the exposure amount.

The above object of the present invention is accomplished by the following constituent.

(1) A direct positive silver halide color photographic light-sensitive material comprising a support and, provided thereon, a blue-sensitive emulsion layer containing previously unfogged internal latent image-forming silver halide grains having a spectral sensitivity to blue-light, a green-sensitive emulsion layer containing previously unfogged internal latent image-forming silver halide grains having a spectral sensitivity to green-light, and a red-sensitive emulsion layer containing previously unfogged internal latent image-forming silver halide grains having a spectral sensitivity to red-light and a hydrophilic colloidal layer, wherein said blue-sensitive emulsion layer is provided so as to be located farther than both said green-sensitive and said red-sensitive emulsion layers from the support, and at least one of said blue-sensitive emulsion layer, said green-sensitive emulsion layer and said red-sensitive emulsion layer or said hydrophilic colloidal layer contains an internal latent image forming silver halide grains having a spectral sensitivity having a part common to the respective spectral sensitivity regions pertaining to said blue-sensitive emulsion layer, said green-sensitive emulsion layer and said red-sensitive emulsion layer; and said spectral sensitivity of said blue-sensitive emulsion layer to said blue-light, is not less than 0.8 of at least one selected from a spectral sensitivity of said green-sensitive emulsion layer to said blue-light or a spectral sensitivity of said red-sensitive emulsion layer to blue-light.

In the present invention, blue-light is defined as a light having a wavelength within the wavelength range of 400 nm to 500 nm, green-light is defined as a light having a wavelength within the wavelength range of 500 nm to 600 nm, and red-light is defined as a light having a wavelength within the wavelength range of 600 nm to 700 nm.

(2) The light-sensitive material of (1), in which where the grain diameter of previously unfogged internal latent image-forming silver halide grains having a spectral sensitivity to blue light is represented by RB, the grain diameter of previously unfogged internal latent image-forming silver halide grains having a spectral sensitivity to green light is represented by RG and the grain diameter of previously unfogged internal latent image-forming silver halide grains having a spectral sensitivity to red light is represented by RR, the grain diameter RB satisfies at least one selected from the group consisting of the relations $$RB/RG \geqq 1.2 \text{ and } RB/RR \geqq 1.2,$$

and the light-sensitive material has a yellow filter layer containing yellow colloidal silver in an upper position than the above blue-sensitive emulsion layer on the other different spectral sensitivities-having layers side of the support, wherein the yellow colloidal silver content of the yellow filter is not more than 0.045 g/m$^2$.

DETAILED DESCRIPTION OF THE INVENTION

The invention is described further in detail.

The previously unfogged internal latent image-forming silver halide grain of the invention is a silver halide grain having a latent image formed mainly thereinside and having the majority of its sensitivity speck thereinside; particularly preferably an emulsion which is such that after coating the emulsion on a transparent support so as to have a silver coating weight of about 1 to 3.5 g/m$^2$ to prepare a film sample, when a part of the sample is exposed for a specified period of 0.1 second to 1 second through a light-intensity scale and processed at 20° C. for 4 minutes in the following surface developer solution A, substantially not containing any silver halide solvent and designed for developing the surface image alone on the grain, while when the other part of the same sample is exposed likewise and processed at 20° C. for 4 minutes in the following internal developer solution B, designed for developing the internal latent image alone on the grain, the maximum density-obtained by the processing in the surface developer A is not more than ⅕, and more preferably not more than 1/10 of that obtained by the processing in the internal developer solution B.

| Surface developer solution A | |
|---|---|
| Metol | 2.5 g |
| L-ascorbic acid | 10.0 g |
| Sodium metaborate, tetrahydrate | 35.0 g |
| Potassium bromide | 1.0 g |
| Water to make | 1000 ml |
| **Internal developer solution B** | |
| Metol | 2.0 g |
| Anhydrous sodium sulfite | 90.0 g |
| Hydroquinone | 8.0 g |
| Sodium carbonate, monohydrate | 52.5 g |
| Potassium bromide | 5.0 g |
| Potassium iodide | 0.5 g |
| Water to make | 1000 ml |

The internal latent image-forming silver halide emulsion of the invention includes those prepared by various methods, such as the conversion-type silver halide emulsion described in U.S. Pat. No. 2,52,250; the silver halide emulsions having internally chemically sensitized silver halide grains described in U.S. Pat. Nos. 3,206,316, 3,317,322 and 3,367,778; the emulsions having polyvalent metallic ions-incorporated silver halide grains described in U.S. Pat. Nos.3,271,157, 3,447,927 and 3,531,291; the silver halide emulsion containing lightly chemically sensitized surface-having doping agent-containing silver halide grains described in U.S. Pat. No. 3,761,278, the silver halide emulsions comprising grains having the stratified structure described in JP O.P.I. Nos. 8524/1975, 38525/1975 and 2408/1978; and other silver halide emulsions as described in JP O.P.I. Nos. 156614/1977 and 127549/1980.

The internal latent image-forming silver halide grain in the invention may be of any arbitrary silver halide such as silver bromide, silver chloride, silver chlorobromide, silver chloroiodide, silver chlorobromide, silver iodobromide or silver chloroiodobromide. The grain containing silver chloride is excellent in the developability, and therefore suitable for rapid processing.

The grain may be in any crystal form, such as cube, octahedron, tetradecahedron in a mixture of (100) and (111) faces, (110) faces-having configuration, and spherical or tabular form. The average grain diameter is preferably 0.05 to 3μm. From the viewpoint of the grain diameter distribution, the emulsion may be of either monodisperse silver halide grains having uniform grain sizes and crystal habits or polydisperse grains having uneven grain sizes and crystal habits, but is preferably a monodisperse silver halide emulsion.

In the invention, the monodisperse silver halide emulsion is an emulsion in which the weight of the silver halide grains included within the average grain diameter rm ±20% range accounts for not less than 60%, preferably not less than 70% and more preferably not less than 80% of that of the whole silver halide grains. The above average grain diameter rm is defined as the grain diameter ri at the time when the product $ni \times ri^3$ of the frequency ni of grains each having a grain diameter ri and $ri^3$ becomes maximum (calculated down to the third desimal place). The above grain diameter, in the case of a spherical silver halide grain, is its diameter, while in the case of nonspherical grain, is the diameter of a circular image equivalent in the area to its projection image. The grain diameter can be obtained as follows:-For example, an electron-microscopically 10,000-fold to 50,000-fold enlarge image of a silver halide grain is photographed to make a print of it, and the diameter or the area of the printed grain image is actually measured, whereby an accurate grain diameter is provided (the number of grains for the measurement shall be not less than 1000 sampled at random).

A particularly highly monodisperse emulsion is one having a grain diameter distribution broadness of not more than 20%, provided that the grain diameter distribution broadness is defined by:

$$\frac{\text{Standard deviation of grain diameters}}{\text{Average grain diameter}} \times 100 = \text{distribution broadness}(\%)$$

wherein the average grain diameter and the standard deviation of grain diameters shall be found from the ri in the above definition.

The monodisperse emulsion can be obtained by adding an aqueous silver nitrate solution and an aqueous halide solution to an aqueous gelatin solution containing seed grains according to a double-jet method under pAg and pH controls. For determination of the adding rate reference can be made to JP O.P.I. Nos. 48521/1979 and 49938/1983. For the preparation of a highly monodisperse emulsion there can be used the method for growing grains in the presence of the tetrazaindene compound disclosed in JP O.P.I. No. 122935/1985.

In the invention, the sensitivity of at least one blue-sensitive emulsion layer to blue light needs to be 0.8, preferably 1.2 and most preferably 2.0 higher than the sensitivity of at least one green-sensitive emulsion layer and/or at least one red-sensitive emulsion layer to blue light.

The above-mentioned 'sensitivity' is defined as the logarithmic value of the reciprocal of the exposure amount to give an intermediate density (Dmin+(Dmax-Dmin)/2) between the maximum density (Dmax) and the minimum density (Dmin).

In the invention, the relations of the mainly blue-sensitive previously unfogged internal latent image-forming silver halide grain diameter RB to the mainly green-sensitive previously unfogged internal latent image-forming silver halide grain diameter RG and the mainly red-sensitive previously unfogged internal latent image-forming silver halide grain diameter RR are defined preferably by $$RB/RG \geqq 1.2 \text{ and/or } RB/RR \geqq 1.2 \text{ , and}$$

more preferably by $$RB/RG \geqq 1.6 \text{ and/or } RB/RR \geqq 1.6.$$

As an embodiment of the invention there is a light-sensitive material comprising a support having thereon a blue-sensitive emulsion-containing yellow image forming layer, a green-sensitive emulsion-containing magenta image forming layer, a red-sensitive emulsion-containing cyan image forming layer and a black image forming layer-containing a panchromatic emulsion sensitive to all rays covering blue, green and red lights. The black image forming layer, even if in an upper position than the yellow filter layer, allows the effective spectral sensitivity separation between the respective color-sensitive layers, so it constitutes no hindrance to the effect of the invention.

In order to form a black image, a black coupler may be used, or a mixture of yellow, magenta and cyan couplers may also be used.

As another embodiment there is a light-sensitive material which, in addition to the blue-sensitive emulsion-containing yellow image forming layer, green-sensitive emulsion-containing magenta image forming layer and red-sensitive emulsion-containing cyan image forming layer, has other yellow image forming layer, magenta image forming layer and cyan image forming layer each independently containing a panchromatic emulsion.

As still another embodiment there is a light-sensitive material which comprises a yellow image forming layer containing both blue-sensitive emulsion and panchromatic emulsion, a magenta image forming layer containing both green-sensitive emulsion and panchromatic emulsion and a cyan image forming layer containing both red-sensitive emulsion and panchromatic emulsion.

Any of these light-sensitive materials may, if necessary, have an intermediate layer, a filter layer and a protective layer in addition to the above-mentioned image forming layers.

In the invention, the yellow colloidal silver content needs to be not more than 0.045 g per square meter. The yellow colloidal silver is preferably added to a hydrophilic colloid layer underneath the blue-sensitive layer except where it is zero.

In the yellow colloidal silver used in the invention, its maximum absorption wavelength in the hydrophilic colloid layer is preferably 380 to 460 nm. The maximum absorption wavelength can be found by comparison in the spectral absorption measured with a spectrophotometer, between the sample prepared by coating a gelatino yellow colloidal silver dispersion product containing a coating aid and a hardener on a transparent support and the comparative sample made by bleaching and fixing the same film sample.

A method for preparing the yellow colloidal silver is described in Weiser, 'Colloidal Elements' (according to Carey Iea's dextrin reduction process), Will & Sons, New York, 1933.

The average grain size of the yellow colloidal silver ranges from 1.4 μm to 0.1 μm, which may be selected according to the purpose for which it is used.

In the invention, the emulsion containing internal latent image-forming silver halide grains is used for positive image formation, so that after being imagewise exposed, the emulsion is subjected to fogging treatment (nucleation treatment) and (or while in) surface development. The fogging treatment can be carried out by application of overall exposure or a nucleating compound, i.e., a fogging agent, to the emulsion.

The overall exposure is performed by uniformly exposing the entire area of the light-sensitive material after being immersed or swelled in a developer solution or other aqueous solution. The light source used in the above exposure may be any as long as it emits light within the wavelength range to which the above light-sensitive material is sensitive, and it includes a light source for high-illuminance short-time exposure like a flash light and a weak light for long-time exposure.

The overall exposure time can be widely varied depending on the developing condition and the kind of the light source used so that the best possitive image can be eventually obtained.

The overall exposure is made most preferably in a certain fixed exposure amount range in combination with the light-sensitive material. Generally speaking, if the exposure amount is given to excess, the minimum density could increase or decrease, whereby the resulting image tends to get deteriorated.

Useful fogging agents for the invention are described.

There are various compounds usable as the fogging agent in the invention. The fogging agent need only be present at the time of development; for example, present in a constituent layer other than the support (particularly in a silver halide emulsion layer) or in a developer solution or a pretreatment solution prior to development. The using amount of the fogging agent may be changed according to purposes. The preferred adding amount, when added to a silver halide emulsion layer, is preferably 1 to 1500 mg, more preferably 10 to 1000 mg per mol of silver halide, and, when added to a processing solution like a developer solution, is preferably 0.01 to 5 g, and more preferably 0.05 g to 1 g per litter.

Examples of the fogging agent of the invention include the hydrazines described in U.S. Pat. Nos. 2,563,785 and 2,588,982; the hydrazide or hydrazine compounds described in U.S. Pat. No. 3,227,552; the heterocyclic quaternary nitrogen chloride compounds described in U.S. Pat. Nos. 3,615,615, 3,718,479, 3,719,494, 3,734,73 Sand 3,759,901; and compounds having an absorption group to the silver halide surface such as the acylhydrazinophenylthioureas described in U.S. Pat. No. 4,030,925. These fogging agents may be used in combination. For example, RD15162 describes the use of a nonabsorption-type fogging agent in combination with an absorption-type fogging agent. The technique of this combined use is effective also in the present invention. In the invention, a fogging agent of either the absorption type or the nonabsorption type can be used, and both types may be used in combination.

Useful examples of the fogging agent include hydrazine compounds such as hydrazine hydrochloride, 4-methylphenylhydrazine hydrochloride, 1-acetyl-2-phenylhydrazine, 1-formyl-2-(4-methylphenyl)hydrazine, 1-methylsulfonyl-2-phenylhydrazine, 1-methylsulfonyl-2-(3-phenylsulfoneamidophenyl)hydrazine, 1-benzoyl-2-phenylhydrazine and formaldehydophenylhydrazine; N-substituted quaternary cycloammonium salts such as 3-(2-formylethyl)-2-methylbenzothiazolium bromide, 3-(2-acetylethyl)-2-benzyl-5-phenylbenzooxazolium bromide, 3-(2-acetylethyl)-2-benzylbenzoselenazolium bromide, 2-methyl-3-[3-(phenylhydrazino)propyl] benzothiazolium bromide, 1,2-dihydro-3-methyl-4-phenylpyrido[2,1-b]benzothiazolium bromide, 1,2-dihydro-3-methyl-4-phenylpyrido[2,1-b]benzoselenazolium bromide, 4,4'-ethylenebis(1,2-dihydro-3-methylpyrido[2,1-b]benzothiazolium bromide; 5-(3-ethyl-2-benzothiazolinylidene)-3-[4-(2-formylhydrazino)phenyl] rhodanine, 1,3-bis[4-(2-formylhydrazino)phenyl] thiourea, 7-(3-ethoxythiocarbonylaminobenzamido)-9-methyl-10-propargyl-1,2,3,4 -tetrahydroacrydiniumtrifluoromethanesulfonate, 1-formyl-2-[4-{3-(2-methoxyphenyl)ureido]phenyl]hydrazine, and the like.

As the developing agent applicable to the developer solution for use in developing the light-sensitive material of the invention there may be used any one of ordinary silver halide developing agents which include polyhydroxybenzenes such as hydroquinone, aminophenols, 3-pyrazolidones, ascorbic acid and its derivatives, reductones, phenylenediamines, and mixtures of these compounds; such as hydroquinone, aminophenol, N-methylaminophenol, 1-phenyl-3-pyrazolidone, 1-phenyl-4,4'-dimethyl-3-pyrazolidone, 1-phenyl-4-methyl-4-hydroxymethyl-3-pyrazolidone, ascobic acid, N,N-diethyl-p-phenylenediamine, diethylamino-o-toluidine, 4-amino-3-methyl-N-ethyl-N-(β-methanesulfonamidoethyl)aniline, 4-amino-N-methyl-N-ethyl-N-(β-hydroxyethyl)aniline, and 4-amino-N-ethyl-N-(β-hydroxyethyl)aniline. It is also possible to have the emulsion in advance contain one or some of these developing agents so that the developing agent can react with the emulsion when immersed in a high pH aqueous solution.

The developer solution used in the invention may further contain specific untifogging agent and development inhibitor, or these developer solution additives may instead be incorporated into an arbitrary component layer of the light-sensitive material.

For the light-sensitive material of the invention known photographic additives may be used.

The above-mentioned known photographic additives include the following compounds described in-RD17643 and RD18716.

| | RD17643 | | RD18716 | |
|---|---|---|---|---|
| Additives | Page | Section | Page | Section |
| Chemical sensitizers | 23 | III | 648 | Upper right |
| Sensitizing dyes | 23 | IV | 648 | Upper right |

-continued

| | RD17643 | | RD18716 | |
|---|---|---|---|---|
| Additives | Page | Section | Page | Section |
| Development accelerators | 29 | XXI | 648 | Upper right |
| Antifoggants | 24 | VI | 649 | Lower right |
| Stabilizers | " | " | " | " |
| Antistain agents | 25 | VII | 650 | Left to right |
| Image stabilizers | 25 | VII | | |
| UV absorbents | 25–26 | VII | 649 right to 650 left | |
| Filter dyes | " | " | " | |
| Brightening agents | 24 | V | | |
| Hardeners | 26 | X | 651 | Right |
| Coating aids | 26–27 | XI | 650 | Right |
| Surfactants | 26–27 | XI | 650 | Right |
| Plasticizers | 27 | XII | 650 | Right |
| Sliding agents | " | " | " | " |
| Antistatic agents | " | " | " | " |
| Matting agents | 28 | XVI | " | " |
| Binder materials | 29 | IX | 651 | Right |

In the emulsion layer of the light-sensitive material of the invention, there may be used a dye forming coupler which exerts a coupling reaction with the oxidation product of a color developing agent to form a dye. To each emulsion layer is usually applied an appropriate coupler selected so as to form a dye that absorbs specific spectral light to which the layer is sensitive; generally, a yellow dye forming coupler is used for the blue-sensitive emulsion layer, a magenta dye forming coupler for the green-sensitive emulsion layer and a cyan dye forming coupler for the red-sensitive emulsion layer. However, the above emulsion/coupler combinations may be altered according to purposes.

The dye forming coupler preferably has in its molecule a group having 8 or more carbon atoms for making the coupler nondiffusible, a so-called ballast group. The dye forming coupler may be either a 4-equivalent coupler that requires four molecules of silver ions to be reduced to form one molecule of a dye or a 2-equivalent coupler that requires only two molecules of silver ions to be reduced to form one molecule of a dye. There may also be used a DIR coupler which, in the course of development, releases a development inhibitor to improve the sharpness and graininess of the resulting image, or a DIR compound which makes a coupling reaction with the oxidation product of a developing agent to produce a colorless compound and at the same time releases a development inhibitor.

The DIR coupler and DIR compound used are each classified into two types: one having an inhibitor directly attached to its coupling position and the other having an inhibitor linked through a divalent group to its coupling position.

Useful examples of the magenta dye forming coupler include known 5-pyrazolone couplers, pyrazolobenzimidazole couplers, pyrazoloazole couplers, acylacetonitrile couplers and indazolone couplers.

Typical examples of the cyan dye forming coupler include known phenol couplers, naphthol couplers and imidazole couplers for example, an alkyl, acylamino or ureido group-substituted phenol couplers, naphthol couplers formed from 5-aminonaphthol skeleton, two-equivalent naphthol couplers into which is introduced an oxygen atom as a split-off group, and the like.

Examples of the black dye forming coupler include those as described in RD16226, JP O.P.I. Nos. 42725/1977, 46029/1978 and 9924/1979.

Materials usable as the support of the light-sensitive material of the invention include those as described in RD-17643, p.28, and RD-18716, p.647. Suitable support is polymer film or paper, which may be subjected to appropriate treatment for increasing its adhesion characteristic or antistatic characteristic.

EXAMPLES

The invention is illustrated further in detail by the following examples, but the invention is not limited thereto.

Example 1

Preparation of Emulsion EM-1

To an aqueous osein gelatin solution, with its temperature being controlled to 40° C., both an aqueous ammonia/silver nitrate solution and an aqueous potassium bromide/sodium chloride solution (molar ratio of KBr:NaCl=95:5) were added simultaneously according to a controlled double-jet method, whereby a cubic silver chlorobromide core emulsion having an average grain diameter of 0.30 μm was obtained. In this instance, pH and pAg were controlled so that grains in the cubic form could be obtained. To the obtained core emulsion were further added both an aqueous ammonia/silver nitrate solution and an aqueous potassium bromide/sodium chloride solution (molar ratio of KBr:NaCl=40:60) simultaneously according to a controlled double-jet method to thereby make shell formation until the average grain diameter reaches 0.42 μm. In this process, pH and pAg were controlled so that grains in the cubic form could be obtained.

Subsequently, to the emulsion, after being washed to remove the water-soluble salts therefrom, was added gelatin, whereby Emulsion EM-1 was obtained. The grain diameter distribution broadness of Emulsion EM-1 was 8%.

Preparation of emulsion EM-1B

Emulsion EM-1 was spectrally sensitized by adding a sensitizing dye BD-1 in an amount of 80 mg per mol of the emulsion, whereby a blue-sensitive emulsion EM-1B was obtained.

Preparation of emulsion EM-1G

Emulsion EM-1 was spectrally sensitized by adding a sensitizing dye GD-1 in an amount of 40 mg per mol of the emulsion, whereby a green-sensitive emulsion EM-1G was obtained.

Preparation of emulsion EM-1R

Emulsion EM-1 was spectrally sensitized by adding a sensitizing dye RD-1 in an amount of 40 mg per mol of the emulsion, whereby a red-sensitive emulsion EM-1R was obtained.

Preparation of emulsion EM-1K

To Emulsion EM-1 were added sensitizing dye BD-1 in an amount of 70 mg/mol of Em, sensitizing dye GD-1 in 35 mg/mol Em, and sensitizing dye RD-1 in 35 mg/mol Em, whereby a blue/green/red-sensitized emulsion EM-K was obtained.

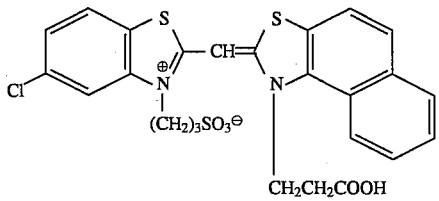

BD-1

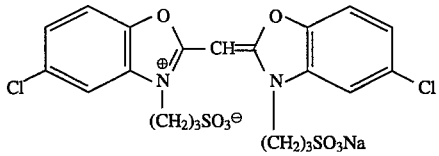

GD-1

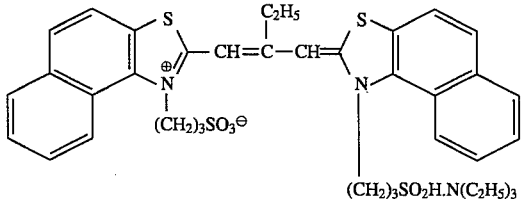

RD-1

On the obverse of a both-sided polyethylene-laminated paper support of 220 μm in thickness were superposedly coated the following Layers 1 to 12, whereby a multilayer color light-sensitive material sample 1—1 was prepared.

The following figures represent coating weights in grams per square meter ($g/m^2$) except that those of silver halide emulsions are in silver equivalents.

| | |
|---|---|
| Layer 12 (UV absorbing layer) | |
| Gelatin | 0.78 |
| UV absorbent UV-1 | 0.065 |
| UV absorbent UV-2 | 0.195 |
| Solvent SO-2 | 0.10 |
| Colloidal silica | 0.03 |
| Layer 11 (panchromatic layer) | |
| Gelatin | 1.05 |
| Emulsion EM-1K | 0.30 |
| Yellow coupler YC-1 | 0.21 |
| Magenta coupler YC-1 | 0.063 |
| Cyan coupler CC-1 | 0.110 |
| Antistain agent AS-2 | 0.019 |
| Solvent SO-1 | 0.615 |
| Layer 10 (interlayer) | |
| Gelatin | 0.75 |
| Anti-color-crossover agent AS-1 | 0.055 |
| Solvent SO-2 | 0.072 |

-continued

| | |
|---|---|
| Layer 9 (blue-sensitive layer) | |
| Gelatin | 1.14 |
| Emulsion EM-1B | 0.40 |
| Yellow coupler YC-1 | 0.656 |
| Antistain agent AS-2 | 0.02 |
| Solvent SO-1 | 0.656 |
| Inhibitor ST-1 | 0.0001 |
| Inhibitor ST-2 | 0.0001 |
| Inhibitor T-1 | 0.001 |
| Layer 8 (interlayer) | |
| Gelatin | 0.54 |
| Anti-color-crossover agent AS-1 | 0.055 |
| Solvent SO-2 | 0.072 |
| Layer 7 (yellow colloidal silver layer) | |
| Gelatin | 0.42 |
| Yellow colloidal silver | 0.04 |
| Anti-color-crossover agent | 0.04 |
| Solvent SO-2 | 0.049 |
| Polyvinylpyrrolidone PVP | 0.047 |
| Layer 6 (interlayer) | |
| Gelatin | 0.54 |
| Anti-color-crossover agent AS-1 | 0.055 |
| Solvent SO-2 | 0.072 |
| Layer 5 (green-sensitive layer) | |
| Gelatin | 1.14 |
| Emulsion EM-1G | 0.40 |
| Magenta coupler MC-1 | 0.20 |
| Antistain agent AS-2 | 0.0152 |
| Solvent SO-1 | 0.248 |
| Inhibitor ST-1 | 0.0001 |
| Inhibitor ST-2 | 0.0001 |
| Inhibitor T-1 | 0.001 |
| Layer 4 (interlayer) | |
| Gelatin | 0.75 |
| Anti-color-crossover agent AS-1 | 0.055 |
| Solvent SO-2 | 0.072 |
| Layer 3 (red-sensitive layer) | |
| Gelatin | 1.10 |
| Emulsion EM-1R | 0.24 |
| Cyan coupler CC-2 | 0.352 |
| Solvent SO-1 | 0.248 |
| Antistain agent AS-2 | 0.012 |
| Inhibitor ST-1 | 0.00006 |
| Inhibitor ST-2 | 0.00006 |
| Inhibitor T-1 | 0.0006 |
| Layer 2 (interlayer) | |
| Gelatin | 0.75 |
| Layer 1 (antihalation layer) | |
| Gelatin | 0.75 |
| Black colloidal silver | 0.07 |
| Anti-color-crossover agent AS-1 | 0.04 |
| Solvent SO-2 | 0.049 |

In coating the above layers, coating aids A-1 and A-2 and a hardener H-1 were used.

T-1: 4-Hydroxy-6-methyl-1,3,3a,7-tetrazaindene
SA-1: Sodium sulfosuccinate-di(2-ethylhexyl)ester
SA-2: Sodium sulfosuccinate-di(2,2,3,3,4,4,5,5-octafluoro-pentyl)ester
H-1: Sodium 2,4-dichloro-6-hydroxy-S-triazine
AS-1: 2,5-di-t-octylhydroquinone
AS-2: 2,5-di-t-butylhydroquinone
SO-1: Trioctyl phosphate
SO-2: Dioctyl phthalate
ST-1: 1-(3-acetamido)phenyl-5-mercaptotetrazole
ST-2: N-benzyladenine
YC-1

-continued

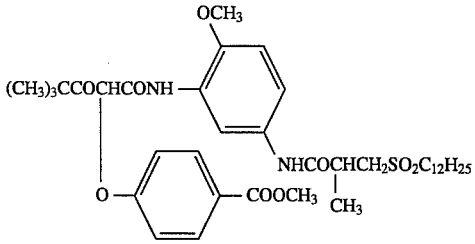

MC-1

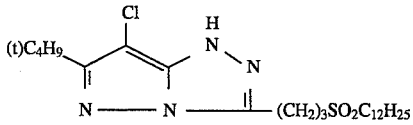

CC-1

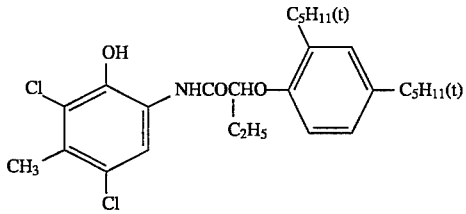

CC-2

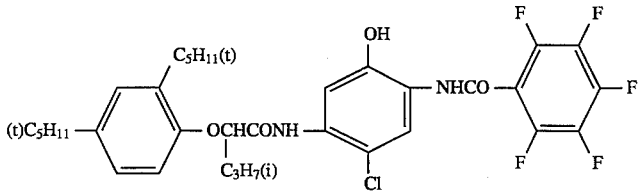

UV-1

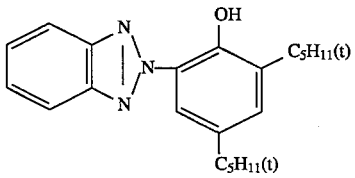

UV-2

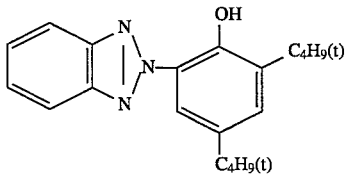

Next, another emulsion different in the grain diameter from Emulsion EM-1 was prepared in the same manner as in Emulsion EM-1, and the emulsion was divided into four parts. The parts were subjected to spectral sensitization treatments in the same ways as in the foregoing emulsions EM-1B, EM-1G, EM-1R and EM-1K, respectively. The thus obtained emulsions were used to prepare Samples 1-2 to 1-5, having grain diameters in the values relative to Sample 1—1 indicated in Table 1 and yellow colloidal silver coating weights changed as shown in Table 1.

TABLE 1

| Sample | Grain diameter of emulsion (Mm) | | | | Grain diameter ratio | | Yellow colloidal silver |
|---|---|---|---|---|---|---|---|
| No. | RK | RR | RG | RB | RB/RG | RB/RR | (g/m$^2$) |
| 1-1 | 0.42 | 0.42 | 0.42 | 0.42 | 1.00 | 1.00 | 0.040 |
| 1-2 | 0.55 | 0.42 | 0.42 | 0.55 | 1.31 | 1.31 | 0.040 |
| 1-3 | 0.55 | 0.36 | 0.36 | 0.55 | 1.53 | 1.53 | 0.040 |
| 1-4 | 0.65 | 0.36 | 0.36 | 0.65 | 1.81 | 1.81 | 0.040 |
| 1-5 | 0.65 | 0.36 | 0.36 | 0.65 | 1.81 | 1.81 | 0.000 |

In the above table, RK represents the grain diameter of the emulsion spectrally sensitive to all the blue, green and red rays.

Each of Samples 1—1 to 1-5 was exposed for 0.5 second through an optical wedge with a blue filter (Wratten No.47B) in a sensitometer, and then had its entire area uniformly exposed through a red filter (Wratten No.26) and ND filter, wherein the ND filter's density was adjusted to give a smallest possible exposure amount to cause the processed cyan density to be minimum. After being processed in the hereinafter described developer solution, the sample was measured for its yellow and magenta densities to find its characteristic curves, from which the sensitivity difference SY-M between the blue-sensitive emulsion and the green-sensitive emulsion was calculated.

Next, each of Samples 1—1 to 1-5 was exposed for 0.5 second through an optical wedge with a blue filter (Wratten No.47B) in the sensitometer, and then had its entire area exposed uniformly through a green filter (Wratten No.58) and a ND filter, wherein the ND filter's density was adjusted to give a smallest possible exposure amount to cause the processed magenta density to be minumum. After being processed in the hereinafter described developer solution, the sample was measured for its yellow and cyan densities to find its characteristic curves, from which the sensitivity difference SY-C between the blue-sensitive emulsion and the red-sensitive emulsion was calculated.

Subsequently, each of Samples 1—1 to 1-5 was exposed through a blue filter (Wratten No.47B) and a ND filter to white light for 0.5 second in an exposure amount controlled to be smallest possible by adjusting the ND filter's density to cause the yellow density processed in the hereinafter described developer solution to be minimum. Further, each sample was exposed through a green filter (Wratten No.58) and a ND filter to white light for 0.5 second in an exposure amount controlled to be smallest possible by adjusting the ND filter's density to cause the magenta density processed in the hereinafter described developer solution to be minimum. After the development, the cyan densities were measured. Next, the above ND filter was changed to increase its density so as to increase the exposure amount to each sample by 1.5 times, and after being processed in the developer solution, the sample was measured for its cyan density to thereby find its cyan density variation ADC to the change in the exposure amount.

Each of Samples 1—1 to 1-5 was exposed through a red filter (Wratten No.26) and a ND filter to white light for 0.5 second in an exposure amount controlled to be smallest possible by adjusting the ND filter's density to cause the cyan density processed in the hereinafter described developer solution to be minimum. Subsequently, each sample was further exposed through a blue filter (Wratten No.47) and a ND filter to white light for 0.5 second in an exposure amount controlled to be smallest possible by adjusting the ND filter's density to cause the yellow density processed in the hereinafter described developer solution to be minimum. After the processing, the magenta densities were measured. Next, the above ND filter was changed to increase its density so as to increase the exposure amount to each sample by 1.5 times, and after being processed, the sample was measured for its magenta density to thereby find its magenta density variation ADM to the change in the exposure amount.

Each of Samples 1—1 to 1-5 was exposed through a green filter (Wrattent No. 58) and a ND filter to white light for 0.5 second in an exposure amount controlled to be smallest possible by adjusting the ND filter's density to cause the magenta density processed in the hereinafter described developer solution to be minimum. And each sample was exposed through a red filter (Wratten No.26) and a ND filter to white light for 0.5 second in an exposure amount controlled to be smallest possible by adjusting the ND filter's density to cause the cyan density processed in the hereinafter described developer solution to be minimum. After the processing, the yellow densities were measured. Next, the above ND filter was changed to increase its density so as to increase the exposure amount to each sample by 1.5 times, and after being processed, the sample was measured for its yellow density to thereby find its yellow density variation ADY to the change in the exposure amount.

Each exposed sample was processed according to the following developing process-1, provided that fogging exposure, when the sample was kept immersed in the developer solution, was made uniformly through the developer solution layer of 3 mm in thickness onto the entire surface of the light-sensitive material sample.

| Developing Process-1 | Temperature | Time |
|---|---|---|
| Immersing in developer solution | 37° C. | 12 seconds |
| Fogging exposure | — | 12 seconds |
| Developing | 37° C. | 95 seconds |
| Bleach-fix | 35° C. | 45 seconds |
| Stabilizing | 25 to 30° C. | 90 seconds |
| Drying | 60 to 80° C. | 40 seconds |

The compositions of the processing solutions used are as follows:

| Color developer solution | |
|---|---|
| Benzyl alcohol | 15.0 ml |
| Cerium(III) sulfate | 0.015 g |
| Ethylene glycol | 8.0 ml |
| Potassium sulfite | 2.5 g |
| Potassium bromide | 0.6 g |
| Sodium chloride | 0.2 g |
| Potassium carbonate | 25.0 g |
| T-1 | 0.1 g |
| Hydroxylamine sulfate | 5.0 g |
| Sodium diethylenetriaminepentaacetate | 2.0 g |
| 4-Amino-N-ethyl-N-β-hydroxyethylaniline sulfate | 4.5 g |
| Brightening agent: 4,4'-diaminostilbene-disulfonic acid derivative | 1.0 g |
| Potassium hydroxide | 2.0 g |
| Diethylene glycol | 15.0 ml |
| Water to make 1000 ml, and adjust pH to 10.15. | |
| **Bleach-fix solution** | |
| Ferric ammonium diethylenetriaminepentaacetate | 90.0 g |
| Diethylenetriaminepentaacetic acid | 3.0 g |
| Ammonium thiosulfate (70% aqueous solution) | 180.0 ml |
| Ammonium sulfite (40% aqueous solution) | 27.5 ml |
| 3-mercapto-1,2,4-triazole | 0.15 g |
| Adjust pH to 7.1 with potassium carbonate or glacial acetic acid, and add water to make 1000 ml. | |
| **Stabilizer solution** | |
| o-Phenylphenol | 0.3 g |
| Potassium sulfite (50% aqueous solution) | 12.0 ml |
| Ethylene glycol | 10.0 g |
| 1-Hydroxyethylidene-1,1-diphosphonic acid | 2.5 g |
| Bismuth chloride | 0.2 g |
| Lead sulfate, heptahydrate | 0.7 g |
| Ammonium hydroxide (28% aqueous solution) | 2.0 g |
| Polyvinylpyrrolidone (K-17) | 0.2 g |
| Brightening agent: 4,4'-diaminostilbene-disulfonic acid derivative | 2.0 g |
| Water to make 1000 ml, and adjust pH to 7.5 with ammonium hydroxide or sulfuric acid. | |

The stabilizing treatment was conducted in a double-bath countercurrent system.

The results after the processing are shown in Table 2.

TABLE 2

| Sample No. | $S_{Y-M}$ | $S_{Y-C}$ | $\Delta D_Y$ | $\Delta D_M$ | $\Delta D_C$ |
|---|---|---|---|---|---|
| 1-1 (Comparative) | 0.36 | 0.52 | 0.07 | 0.62 | 0.52 |
| 1-2 (Invention) | 1.26 | 1.40 | 0.05 | 0.12 | 0.10 |
| 1-3 (Invention) | 1.92 | 2.08 | 0.04 | 0.07 | 0.06 |
| 1-4 (Invention) | 2.40 | 2.58 | 0.04 | 0.05 | 0.05 |
| 1-5 (Invention) | 2.02 | 2.18 | 0.05 | 0.07 | 0.06 |

As is apparent from the results in Table 2, each of the samples of the invention enables the obtaining of a satisfactory color proof having little or no density variation against fluctuation in the exposure amount.

Example 2

The emulsions -EM-1B, EM-1G, EM-1R and EM-1K described in Example 1 were used to superposedly coat the following Layers 1 to 10 on the obverse side of a both-sided polyethylene-laminated paper support of 220 gm in thickness, whereby a color light-sensitive material sample 2-1 was prepared.

The following figures represent coating weights in grams per square meter (g/m$^2$) except that those of silver halide emulsion are silver equivalents.

| | |
|---|---|
| Layer 10 (UV absorbing layer) | |
| Gelatin | 0.78 |
| UV absorbent UV-1 | 0.065 |
| UV absorbent UV-2 | 0.195 |
| Solvent SO-2 | 0.10 |
| Colloidal silica | 0.03 |
| Layer 9 (blue-sensitive layer) | |
| Gelatin | 1.14 |
| Emulsion EM-1B | 0.40 |
| Emulsion EM-1K | 0.10 |
| Yellow coupler YC-1 | 0.656 |
| Antistain agent AS-2 | 0.02 |
| Solvent SO-1 | 0.656 |
| Inhibitor ST-1 | 0.0001 |
| Inhibitor ST-2 | 0.0001 |
| Inhibitor T-1 | 0.001 |
| Layer 8 (interlayer) | |
| Gelatin | 0.54 |
| Anti-color-crossover agent AS-1 | 0.055 |
| solvent SO-2 | 0.072 |
| Layer 7 (yellow colloidal silver layer) | |
| Gelatin | 0.42 |
| Yellow colloidal silver | 0.04 |
| Anti-color-crossover agent AS-1 | 0.04 |
| Solvent SO-2 | 0.049 |
| Polyvinylpyrrolidone PVP | 0.047 |
| Layer 6 (interlayer) | |
| Gelatin | 0.54 |
| Anti-color-crossover agent AS-1 | 0.055 |
| Solvent SO-2 | 0.072 |
| Layer 5 (green-sensitive layer) | |
| Gelatin | 1.14 |
| Emulsion EM-1G | 0.40 |
| Emulsion EM-1K | 0.08 |
| Magenta coupler MC-1 | 0.20 |
| Antistain agent AS-2 | 0.0152 |
| Solvent SO-1 | 0.248 |
| Inhibitor ST-1 | 0.0001 |
| Inhibitor ST-2 | 0.0001 |
| Inhibitor T-1 | 0.001 |
| Layer 4 (interlayer) | |
| Gelatin | 0.75 |

-continued

| | |
|---|---|
| Anti-color-crossover agent AS-1 | 0.055 |
| Solvent SO-2 | 0.072 |
| Layer 3 (red-sensitive layer) | |
| Gelatin | 1.10 |
| Emulsion EM-1R | 0.24 |
| Emulsion EM-1K | 0.06 |
| Cyan coupler CC-2 | 0.352 |
| Solvent SO-1 | 0.248 |
| Antistain agent AS-2 | 0.012 |
| Inhibitor ST-1 | 0.00006 |
| Inhibitor ST-2 | 0.00006 |
| Inhibitor T-1 | 0.0006 |
| Layer 2 (interlayer) | |
| Gelatin | 0.55 |
| Layer 1 (antihalation layer) | |
| Gelatin | 0.75 |
| Black colloidal silver | 0.07 |
| Anti-color-crossover agent | 0.04 |
| Solvent SO-2 | 0.049 |

In coating the above layers, coating aids SA-1 and SA-2 and a hardener H-1.

Next, another emulsion different in the grain diameter from Emulsion EM-1 was prepared in the same manner as in Emulsion EM-1, and was divided into four parts. The parts were subjected to spectral sensitization treatments in the same ways as in the foregoing emulsions EM-1B, EM-1G, EM-1R and EM-1K, respectively. The thus obtained emulsions were used to prepare Samples 2—2 to 2-5, which have grain diameters in the relative values to sample 2-1 indicated in Table 3 and yellow colloidal silver coating weights changed as shown in Table 3.

TABLE 3

| Sample | Grain diameter of emulsion (Mm) | | | | Grain diameter ratio | | Yellow colloidal silver |
|---|---|---|---|---|---|---|---|
| No. | RK | RR | RG | RB | RB/RG | RB/RR | (g/m$^2$) |
| 2-1 | 0.42 | 0.42 | 0.42 | 0.42 | 1.00 | 1.00 | 0.040 |
| 2-2 | 0.55 | 0.42 | 0.42 | 0.55 | 1.31 | 1.31 | 0.040 |
| 2-3 | 0.55 | 0.36 | 0.36 | 0.55 | 1.53 | 1.53 | 0.040 |
| 2-4 | 0.65 | 0.36 | 0.36 | 0.65 | 1.81 | 1.81 | 0.040 |
| 2-5 | 0.65 | 0.36 | 0.36 | 0.65 | 1.81 | 1.81 | 0.000 |

In the above table, RK represents the grain diameter of the emulsion spectrally sensitive to all the blue, green and red rays.

Each of Samples 2-1 to 2-5 was exposed, processed and evaluated the same manner as in Example 1. The obtained results are shown in Table 4.

TABLE 4

| Sample No. | $S_{Y-M}$ | $S_{Y-C}$ | $\Delta D_Y$ | $\Delta D_M$ | $\Delta D_C$ |
|---|---|---|---|---|---|
| 2-1 (Comparative) | 0.40 | 0.56 | 0.06 | 0.50 | 0.40 |
| 2-2 (Invention) | 1.36 | 1.51 | 0.04 | 0.08 | 0.06 |
| 2-3 (Invention) | 2.01 | 2.14 | 0.03 | 0.03 | 0.02 |
| 2-4 (Invention) | 2.47 | 2.66 | 0.03 | 0.02 | 0.02 |
| 2-5 (Invention) | 2.11 | 2.26 | 0.03 | 0.03 | 0.02 |

As is apparent from the results in Table 4, each of the samples of the invention enables the obtaining of satisfactory color proof having little or no density variation against fluctuation in the exposure amount.

What is claimed is:

1. A direct positive silver halide color photographic light-sensitive material comprising a support having provided thereon, a blue-sensitive emulsion layer containing previously unfogged internal latent image forming silver halide grains having a spectral sensitivity to blue light, a green-sensitive emulsion layer containing previously unfogged internal latent image forming silver halide grains having a spectral sensitivity to green light, a red-sensitive emulsion layer containing previously unfogged internal latent image forming silver halide grains having a spectral sensitivity to red light, and a hydrophilic colloidal layer; wherein either said blue-sensitive emulsion layer is farther from said support than each of said green-sensitive emulsion layer and said red-sensitive emulsion layer, and at least one of said blue-sensitive emulsion layer, said green-sensitive emulsion layer, and said red-sensitive emulsion layer contains internal latent image forming silver halide grains having a spectral sensitivity partially in common with the spectral sensitivity regions of each of said blue-sensitive emulsion layer, said green-sensitive emulsion layer, and said red-sensitive emulsion layer, or said hydrophilic colloidal layer contains internal latent image forming silver halide grains having a spectral sensitivity partially in common with the spectral sensitivity regions of said blue-sensitive emulsion layer, said green-sensitive emulsion layer, and said red-sensitive emulsion layers;

said spectral sensitivity of said blue-sensitive emulsion layer to said blue light being not less than 0.8 of at least one of a spectral sensitivity of said green-sensitive emulsion layer to said blue light, or a spectral sensitivity of said red-sensitive emulsion layer to blue light.

2. The direct positive silver halide color photographic light-sensitive material of claim 1, wherein said spectral sensitivity of said blue-sensitive emulsion layer to said blue-light, is not less than 1.2 of at least one selected from a spectral sensitivity of said green-sensitive emulsion layer to said blue-light or a spectral sensitivity of said red-sensitive emulsion layer to blue-light.

3. The direct positive silver halide color photographic light-sensitive material of claim 1, wherein said spectral sensitivity of said blue-sensitive emulsion layer to said blue-light, is not less than 2.0 of at least one selected from a spectral sensitivity of said green-sensitive emulsion layer to said blue-light or a spectral sensitivity of said red-sensitive emulsion layer to blue-light.

4. The direct positive silver halide color photographic light-sensitive material of claim 1, wherein said material satisfies at least one formula selected from the group consisting of formulae 1 and 2:

formula 1: $RB/RG \geqq 1.2$ formula 2: $RB/RR \geqq 1.2$, wherein RB represents a grain diameter of said blue-sensitive emulsion layer, and RG represents a grain diameter of said green-sensitive emulsion layer, and RR represents a grain diameter of said red-sensitive emulsion layer, and said material comprises a yellow filter layer containing yellow colloidal silver of not more than 0.045 $g/m^2$, being located in an upper position than said green-sensitive and said red-sensitive emulsion layers from said support.

5. The direct positive silver halide color photographic light-sensitive material of claim 4, wherein said material satisfies at least one formula selected from the group consisting of formulae 1 and 2:

formula 1: $RB/RG \geqq 1.6$ formula 2: $RB/RR \geqq 1.6$.

* * * * *